US009616491B2

(12) United States Patent
Zhou et al.

(10) Patent No.: US 9,616,491 B2
(45) Date of Patent: Apr. 11, 2017

(54) SPLIT-TYPE MOLD FOR WHEEL CASTING

(71) Applicant: CITIC Dicastal CO., LTD, Qinhuangdao (CN)

(72) Inventors: Peng Zhou, Qinhuangdao (CN); Yongning Wang, Qinhuangdao (CN); Zhihua Zhu, Qinhuangdao (CN); Changhai Li, Qinhuangdao (CN); Hongbiao Li, Qinhuangdao (CN); Xiwei Xue, Qinhuangdao (CN); Yong Li, Qinhuangdao (CN); Gui Wang, Qinhuangdao (CN); Longtao Kang, Qinhuangdao (CN); Donghui Zhang, Qinhuangdao (CN)

(73) Assignee: CITIC Dicastal Co., LTD, Qinhuangdao (CN)

( * ) Notice: Subject to any disclaimer, the term of this patent is extended or adjusted under 35 U.S.C. 154(b) by 0 days.

(21) Appl. No.: 15/184,090

(22) Filed: Jun. 16, 2016

(65) Prior Publication Data

US 2016/0368042 A1 Dec. 22, 2016

(30) Foreign Application Priority Data

Jun. 16, 2015 (CN) ..... 2015 1 0331439

(51) Int. Cl.
*B22C 9/28* (2006.01)
*B22C 9/06* (2006.01)
*B22D 18/04* (2006.01)

(52) U.S. Cl.
CPC ..... *B22C 9/065* (2013.01); *B22C 9/28* (2013.01); *B22D 18/04* (2013.01)

(58) Field of Classification Search
CPC ..... B22C 9/28; B22D 18/04
See application file for complete search history.

(56) References Cited

U.S. PATENT DOCUMENTS 4,117,878 A * 10/1978 Najmowicz ..... B22D 13/101 164/292
4,492,264 A * 1/1985 Gaddi ..... B60B 3/06 164/292
5,311,918 A * 5/1994 Scott ..... B60B 3/06 164/113

(Continued)

FOREIGN PATENT DOCUMENTS

JP GB 2253171 B * 8/1994 ..... B22C 9/28
JP 2005152963 A * 6/2005

*Primary Examiner* — Kevin E Yoon
(74) *Attorney, Agent, or Firm* — Maier & Maier, PLLC

(57) ABSTRACT

The invention provides a split-type mold for wheel casting, the mold having an upper die, a split-type water-cooling side die and a lower die, and the split-type water-cooling side die is divided into four pieces along a circumferential direction of the wheel mold. A thermal deformation arc compensation surface is machined on ¼ arc portion of each split-type water-cooling lower side die, and a compensation surface is machined on key portions of 45-degree matching surfaces of adjacent split-type water-cooling upper side dies. The side die can effectively solve the problems such as untight matching between the matching surfaces, flashes of the matching surfaces and aluminum sticking and the like due to the thermal deformation and non-homogeneous expansion and shrinkage of the two portions of the split-type water-cooling side die.

4 Claims, 4 Drawing Sheets

(56) References Cited

U.S. PATENT DOCUMENTS

| | | | | |
|---|---|---|---|---|
| 5,647,426 | A * | 7/1997 | Prieto | B22C 9/28 164/122.1 |
| 6,318,446 | B1 * | 11/2001 | Nichols | B60B 3/06 164/137 |
| 6,443,217 | B1 * | 9/2002 | May | B22C 9/28 164/340 |

* cited by examiner

SPLIT-TYPE MOLD FOR WHEEL CASTING

TECHNICAL FIELD

The present invention relates to the field of casting, and more particularly to a split-type water-cooling side die.

BACKGROUND ART

In the market, the casting accuracy of aluminum alloy wheels is increasingly improved by finished automobile manufacturers. This is due to that the balance and aesthetics of aluminum alloy wheels greatly depend on whether the product is accurately realized according to the dimensions of design drawings in the casting and machining processes of aluminum alloy.

In the manufacturing of the aluminum alloy wheels, the low-pressure casting is a relatively mature technology. In the actual production, it needs to cool the low-pressure casted mold (such as side die) during the casting process. The split-type side die is adopted in water-cooling of low-pressure casted wheel mold, which has better effect in practical application. In industrial productions, the split-type side die is widely applied. This is due to its simple assembly and lower production and repairing costs.

However, the split-type side die has a large temperature difference between areas close to and away from water-cooling. Specifically, the temperature of the water-cooling portion is lower, the shrinkage of the mold at this portion is more serious; the temperature of the area away from the water-cooling is higher and the shrinkage of the mold at this portion is less than that at the previous portion. Deformation difference of the split-type side die seriously affects the side die and the lower die which are accurately matched, causing the problems such as flashing, aluminum-sticking of the matching surfaces. Because the structure and fastening means of the split-type mold of low-pressure cast aluminum wheel are complicated, it is hard to explicitly calculate and estimate the factors of thermal expansion and cold contraction of the split-type mold, it is difficult to overcome the casting dimensional error caused by deformation of the mold by providing allowance in the design, and it also brings great difficulties to subsequent machining process.

Meanwhile, the partial shrinkage phenomenon caused by thermal expansion and cold contraction of the mold causes the mold easily to be damaged and reduces the lifetime of the mold. In the field of casting, the mold cost is a very key part of the casting cost. Viewed from the production practice, the split-type water-cooling mold is usually damaged from the middle part of the split-type side die at first, such as deformation and damage of the mold caused by thermal fatigue, thermal deformation, extrusion, etc.

In this filed, it is always hoped to design a new type of mold to overcome this problem, increase the lifetime of the mold, decrease the mold cost in the production, improve the dimensional accuracy of wheel in the casting process as much as possible and overcome the defects such as flashing, aluminum-sticking and so on. If this problem is overcome, the service life of the mold can be prolonged, the work-hours and consumables can be saved in the machining, the manufacturing cost of the wheel can be reduced, the utilization efficiency of metal can be increased and the profitability of enterprise can be improved.

SUMMARY OF THE INVENTION

Therefore, an object of the present invention is to design a novel split-type water-cooling side die to overcome the above-described problems of flashing, aluminum-sticking and extruded deformation damage of the mold.

To achieve the above object, the present invention provides the following technical solution:

In an aspect of the present invention, a split-type mold for wheel casting is provided. The mold comprises an upper die, a split-type water-cooling side die and a lower die, and the split-type water-cooling side die is divided into four pieces along a circumferential direction of the wheel mold, which is characterized in that:

a thermal deformation arc compensation surface having points B, C as end points and passing through point E is machined on ¼ arc matching surface of each split-type water-cooling lower side die, i.e. an arc surface matched with a side wall of the lower die; a distance from the point E on the thermal deformation arc compensation surface to a point F on an original arc is 0.2 mm to 0.5 mm; and the points B, C are located on the original arc and respectively have a distance of 60 mm to 80 mm to a 45-degree matching surface;

compensation surfaces are machined on key portions of 45-degree matching surfaces of adjacent split-type upper side dies, i.e. matching surfaces of four side dies, such that V-gaps are formed on the 45-degree matching surfaces of the side dies in a cold state when adjacent split-type upper side dies are matched, with a gap clearance of 0.2 mm to 0.4 mm on the side die inner circumference, and there is no gap on the side die inner circumference when 45-degree matching surfaces of split-type lower side dies, i.e. matching surfaces of four side dies, are in a matching state.

In a preferred aspect of the present invention, the distance from the point E to the point F is 0.2 mm.

In a preferred aspect of the present invention, the gap clearance on the side die inner circumference is 0.3 mm when the 45-degree matching surfaces of the split-type upper side dies are in a matching state.

In a preferred aspect of the present invention, the range of the V-gap on the 45-degree matching surface of the spit-type upper side die is located between points I and J as shown in FIG. 3, wherein the point I is a parting surface of the spit-type upper side die and the spit-type lower side die, and the point J is a tangent point between a 9-degree slope of a hub inner rim and an arc.

According to the technical solution of the thermal deformation compensation for low-pressure casting wheel mold of the present invention, on the premise of not influencing the casting process, a thermal deformation arc compensation surface is machined on ¼ arc of the split-type lower side die by complying with mold thermal deformation laws, and properly setting the thermal deformation compensation amount within the key range of the 45-degree matching surfaces of the split-type upper side dies, so as to achieve precise matching in a hot state.

The technical solution of the present invention brings the following beneficial technical effects:

(1) the thermal deformation compensation set on ¼ arc matching surfaces of four split-type lower side dies achieves a tighter and more precise arc matching between the lower side die and the lower die;

(2) the gaps formed in 45-degree matching surfaces of the split-type upper side dies reduce the stress caused by the expansion of the side dies, and prolong the service life of the mold, thus enabling 45-degree matching surfaces of the side dies to be tighter, and reducing flashes;

(3) the side die can effectively solve the problems such as untight matching between the matching surfaces, flashes of the matching surfaces and aluminum sticking and the like caused by a great deformation difference between the two portions of the split-type water-cooling side die.

BRIEF DESCRIPTION OF THE DRAWINGS

The embodiments of the present invention can be described in details in conjunction with the accompanying drawings, wherein.

DETAILED DESCRIPTION OF THE EMBODIMENTS

Embodiment 1: Mold Manufacturing

On the premise of not influencing the casting process and complying with mold thermal deformation laws, thermal deformation compensation amounts on the arc side matching surfaces between the side dies and between the side die and the lower die are properly set.

Figure 1:
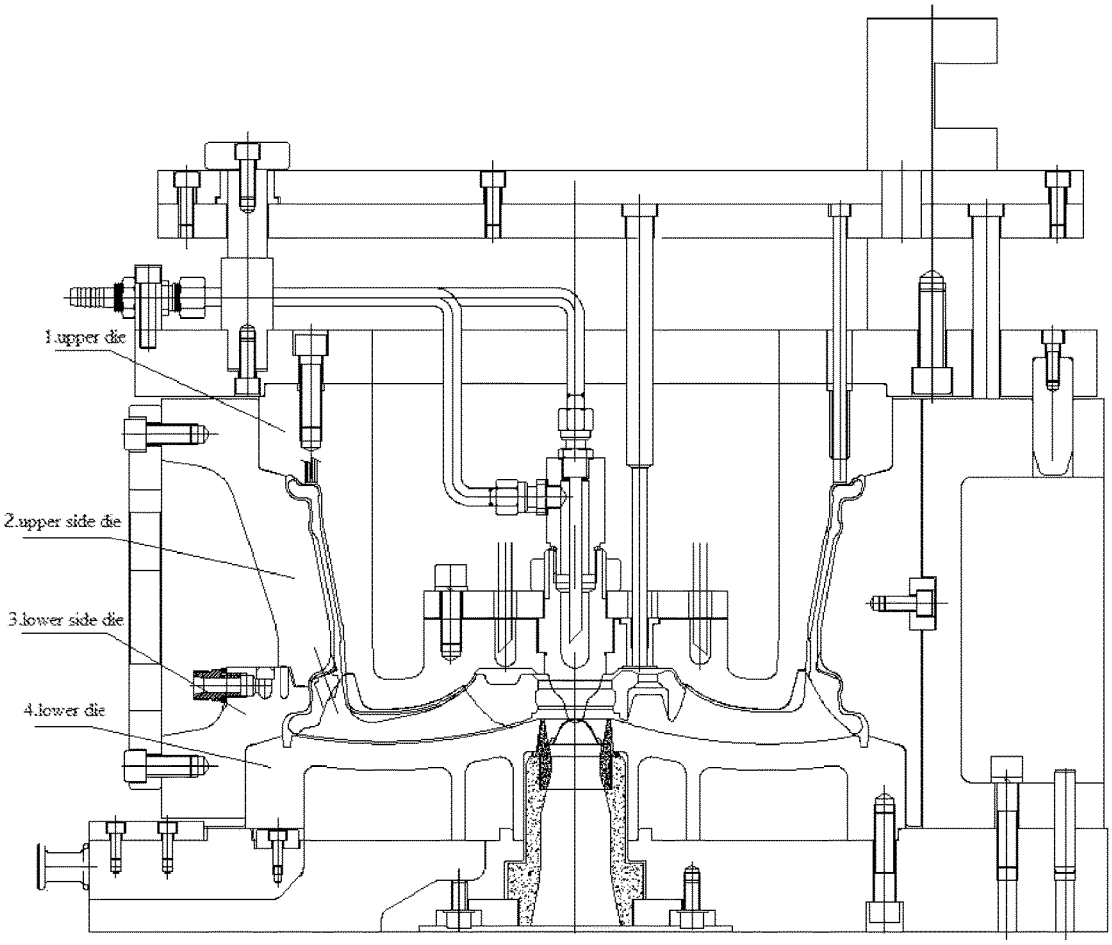
FIG. 1 illustrates the matching form of side dies of the low-pressure casting wheel mold in the prior art, in which 1—upper die, 2—upper side die, 3—lower side die, and 4—lower die.
Figure 2:
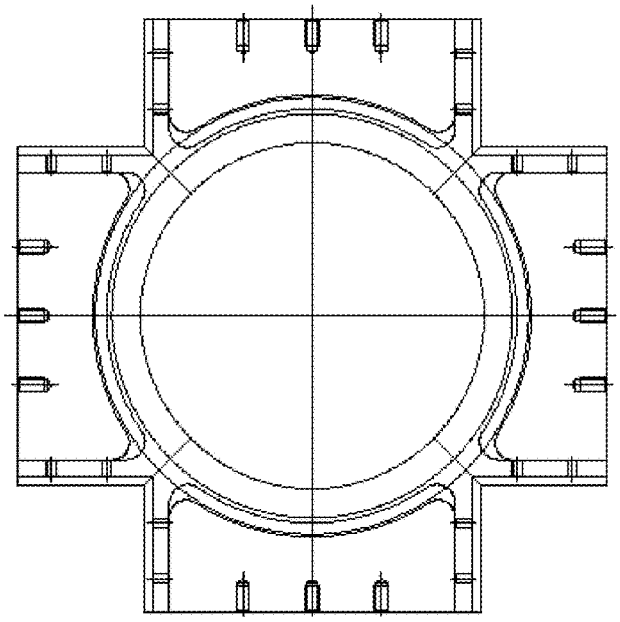
Fig.2 PRIOR ART
FIG. 2 is a schematic of side die matching in the prior art.
Figure 3:
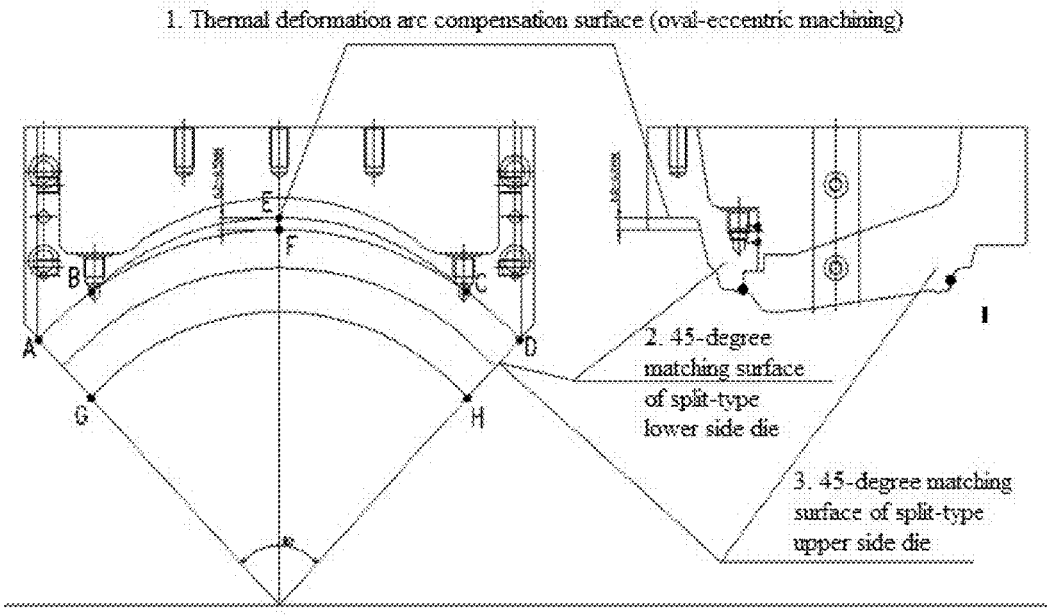
FIG. 3 is a schematic of a thermal deformation compensation surface at ¼ arc matching portions of the split-type water-cooling lower side die in the present invention.
Figure 4:
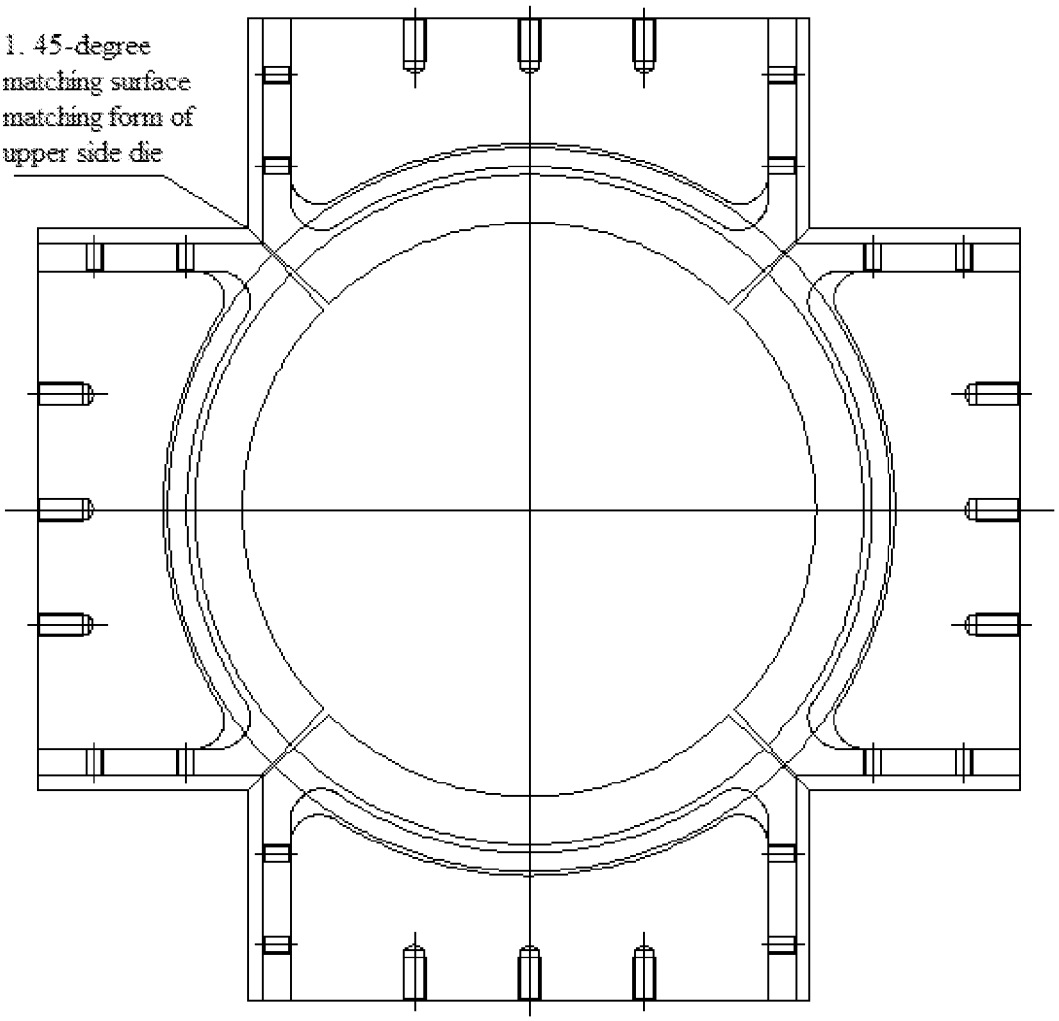
FIG. 4 is a schematic of a thermal deformation matching of 45-degree matching surface of split-type upper side dies.
Figure 5:
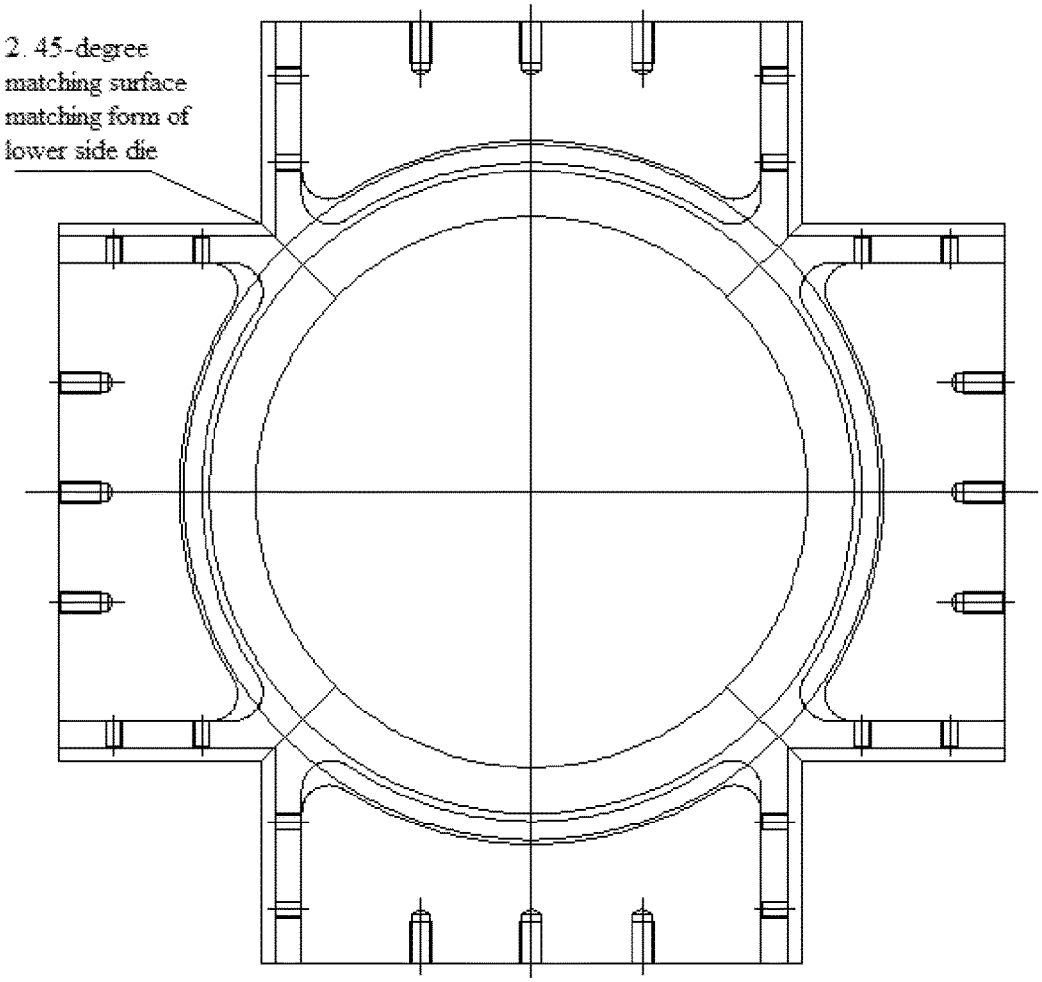
FIG. 5 is a schematic of a thermal deformation matching of 45-degree matching surfaces of split-type lower side dies.

I. As shown in FIG. 3, five points A, B, F, C and D are concyclic (arc line before improvement); three points B, E and C are concyclic as the thermal deformation compensation portions; two points E and F have the maximum distance of 0.2 mm; being closer to the points B and C, a distance between two arcs is gradually smaller until the arcs are intersected); the points A, B, E, C and D form the improved arc line; the points B and C are located on an original arc, and 60 mm away from a 45-degree matching surface, respectively;

II. No thermal deformation compensation amount is left for the 45-degree matching surface of the split-type water-cooling lower side die, while a thermal deformation compensation amount of 0.3 mm is used for the 45-degree matching surface of the split-type upper side die (non-water-cooling portion) to achieve a precise matching in the hot state;

III. Programmed milling is performed on the thermal compensation arc surface formed by the points B, E and C on ¼ arc of split-type water-cooling lower side die; for the thermal compensation portion of the gap at the 45-degree matching surface of the split-type upper side die, the rotation angle of 45-degree matching surface is calculated according to the compensation amount, and gradual milling is performed within the range between I and J in the key portions of the 45-degree matching surface.

The above mold is referred to as test group 1. In addition, molds are also obtained by being machined under the following parameters:

test group 2: the point E on the thermal deformation arc compensation surface and the point F on the original arc have a distance of 0.2 mm; the points B, C are located on the original arc, and 60 mm away from the 45-degree matching surface, respectively; a gap clearance in the side die inner circumference is 0.2 mm;

test group 3: the point E on the thermal deformation arc compensation surface and the point F on the original arc have a distance of 0.5 mm; the points B, C are located on the original arc, and 80 mm away from the 45-degree matching surface, respectively; a gap clearance in the side die inner circumference is 0.4 mm;

test group 4: the point E on the thermal deformation arc compensation surface and the point F on the original arc have a distance of 0.4 mm; the points B, C are located on the original arc, and 70 mm away from the 45-degree matching surface, respectively; a gap clearance in the side die inner circumference is 0.3 mm;

control group: the casting mold of the conventional aluminum wheel integrated side die, which is distinguished from the test group 1 in that it does not include the thermal deformation compensation portion.

Embodiment 2: Pilot Scale Test

The mold manufactured in the method of Embodiment 1 is used for a casting test of A356 aluminum alloy hub under the normal operating conditions of the mold (aluminum liquid of 700 Celsius degrees, and the mold temperature is remained at the normal temperature field). The results show that in the casting tests concerning 5,000 pieces, the proportion of matching surface flashing of the castings is decreased from 100% to 2%, and the proportion of aluminum-sticking is decreased from 70% to 0.5%.

At the same time, a life test is performed to the mold in the same method. The test proves that the life of the mold is improved from 20,000 pieces to 35,000 pieces; in overall consideration of the loss of the flashing, improvement of the life of the mold, stability of the on-site production takt, the cost for casting every 10,000 pieces of hubs is saved by 29300 CN Yuan.

Tests are also performed on test groups 2-4. The results show that the proportion of matching surface flashing of the castings is decreased below 5%, the aluminum-sticking proportion is decreased below 0.9%, and the life of the mold is increased above 32,000 pieces. The molds of the above test groups greatly reduce the hub production cost, and bring in good economic and social benefits.

The invention claimed is:

1. A split-type mold for wheel casting, the mold comprising:

an upper die, a split-type water-cooling side die and a lower die, the split-type water-cooling side die being divided into four pieces along a circumferential direction of a wheel mold, and further comprising:

a thermal deformation arc compensation surface having points B, C as end points and passing through point E is machined on ¼ arc matching surface of a lower side die of each split-type water-cooling side die, that is an arc surface matched with a side wall of the lower die; a distance from the point E on the thermal deformation arc compensation surface to a point F on an original arc is 0.2 mm to 0.5 mm; and the points B, C are located on the original arc and respectively have a distance of 60 mm to 80 mm to a 45-degree matching surface;

compensation surfaces are machined on key portions of 45-degree matching surfaces of adjacent split-type upper side dies, that is matching surfaces of four side dies, such that V-gaps are formed on the 45-degree matching surfaces of the side dies in a cold state when adjacent split-type upper side dies are matched, with a gap clearance of 0.2 mm to 0 4 mm on the side die inner circumference, and there is no gap on the side die inner circumference when 45-degree matching surfaces of split-type lower side dies, i.e. matching surfaces of four side dies, are in a matching state.

2. The mold according to claim 1, wherein the distance from the point E to the point F is 0.2 mm.

3. The mold according to claim 1, wherein the gap clearance on the side die inner circumference is 0.3 mm when the 45-degree matching surfaces of the split-type upper side dies are in a matching state.

4. The mold according to claim 1, wherein the range of the V-gap on the 45-degree matching surface of the spit-type upper side die is located between points I and J, wherein a point I is a parting surface of the spit-type upper side die and the spit-type lower side die, and the point J is a tangent point between a 9-degree slope of a hub inner rim and an arc.

* * * * *